US009877587B2

(12) United States Patent
Grace

(10) Patent No.: US 9,877,587 B2
(45) Date of Patent: Jan. 30, 2018

(54) FOLDING CHAIR WITH SLIDE-OUT TABLE

(71) Applicant: Daniel R. Grace, Old Saybrook, CT (US)

(72) Inventor: Daniel R. Grace, Old Saybrook, CT (US)

(73) Assignee: GCI OUTDOOR, INC., Higganum, CT (US)

( * ) Notice: Subject to any disclaimer, the term of this patent is extended or adjusted under 35 U.S.C. 154(b) by 82 days.

(21) Appl. No.: 14/991,107

(22) Filed: Jan. 8, 2016

(65) Prior Publication Data

US 2016/0198856 A1 Jul. 14, 2016

Related U.S. Application Data

(60) Provisional application No. 62/101,357, filed on Jan. 8, 2015.

(51) Int. Cl.

| | |
|---|---|
| ***A47B 83/02*** | (2006.01) |
| ***A47B 5/00*** | (2006.01) |
| ***A47C 4/20*** | (2006.01) |
| ***A47C 5/10*** | (2006.01) |
| ***A47C 7/62*** | (2006.01) |
| ***A47C 7/68*** | (2006.01) |
| ***A47C 4/12*** | (2006.01) |
| ***A47C 4/22*** | (2006.01) |

(52) U.S. Cl.

CPC ..... *A47C 7/68* (2013.01); *A47B 5/00* (2013.01); *A47B 83/02* (2013.01); *A47C 4/12* (2013.01); *A47C 4/20* (2013.01); *A47C 4/22* (2013.01); *A47C 5/10* (2013.01); *A47C 7/62* (2013.01)

(58) Field of Classification Search

CPC .. A47B 83/02; A47B 3/14; A47B 5/00; A47C 4/20; A47C 4/24; A47C 4/44; A47C 4/48; A47C 5/10; A47C 7/62; A47C 7/68; A47C 7/70

USPC ..... 297/46, 144, 173, 188.11

See application file for complete search history.

(56) References Cited

U.S. PATENT DOCUMENTS

| | | | | | |
|---|---|---|---|---|---|
| 5,564,779 | A * | 10/1996 | Tolbert | A47C 7/70 | 297/144 |
| 5,873,624 | A * | 2/1999 | Simpson | A47C 4/283 | 297/173 |
| 6,364,411 | B1 * | 4/2002 | Zheng | A47C 4/286 | 297/135 |
| D536,886 | S * | 2/2007 | Hart | D6/336 | |
| 9,332,849 | B2 * | 5/2016 | Wagner | A47C 7/021 | |
| 2006/0170255 | A1 * | 8/2006 | Huang | A47D 1/02 | 297/39 |

(Continued)

*Primary Examiner* — Ryan D Kwiecinski

(74) *Attorney, Agent, or Firm* — McCormick, Paulding & Huber LLP

(57) ABSTRACT

A folding chair includes a chair frame that is foldable about a plurality of laterally extending axes between a set up condition and a folded condition, and includes a table that is slidably attached to the chair frame for lateral motion between a deployed position outside a spatial envelope of the chair frame and a stowed position within the spatial envelope of the chair frame, and that is pivotally attached to the chair frame such that when the chair frame is in its set up condition the table is disposed below a seat of the chair frame, and when the chair frame is in its folded condition the table is disposed substantially coplanar with the seat of the chair frame.

19 Claims, 3 Drawing Sheets

(56) References Cited

U.S. PATENT DOCUMENTS

| | | | | |
|---|---|---|---|---|
| 2011/0227374 | A1* | 9/2011 | Zhu | A47C 7/62<br>297/46 |
| 2014/0110976 | A1* | 4/2014 | Tang | A47C 5/10<br>297/173 |
| 2017/0188711 | A1* | 7/2017 | Howell | A47C 7/70 |

* cited by examiner

FOLDING CHAIR WITH SLIDE-OUT TABLE

CROSS-REFERENCE RELATED APPLICATIONS

This application is a non-provisional of, and claims the priority under 35 USC § 119(e) from, U.S. Provisional App. No. 62/101,357 filed Jan. 8, 2015, incorporated herein by reference in its entirety.

BACKGROUND

Technical Field

The invention relates to folding furniture and, more particularly, to folding chairs and tables.

Discussion of Art

Collapsible portable furnishings, such as folding tables and folding chairs, have become increasingly popular for purposes as diverse as beach going, woods camping, and tailgating. Commonly, folding chairs and folding tables are provided as separate pieces of furniture with each folding table being designed to accommodate a plurality of folding chairs around the table. Folding tables generally are provided to stand only at conventional dining table height of about thirty inches, whereas folding chairs can be provided to seat a user at any height from about six inches (low beach chairs) to about twelve inches (standard beach chairs) to about eighteen inches (dining chairs).

In case a beach chair user wants to use a folding table, there presently is not any product known to the inventors that will comfortably accommodate the beach chair user. For example, a conventional folding table clearly will not be suitable for use by someone seated in a beach chair. Also, a conventional folding table would have to be carried around in addition to the beach chair, presenting an awkward inconvenience to the beach chair user.

Thus, there is a longstanding need for a product that provides a collapsible portable folding chair in combination with a collapsible portable table.

BRIEF DESCRIPTION

Embodiments of the present invention provide a folding chair in combination with a slide out table disposed below the seat of the chair. The frame of the chair folds about lateral pivot axes, and the table slides laterally parallel to the pivot axes of the chair between a deployed position and a stowed position. When the table is stowed and the chair is folded, the table is entirely nested within the spatial envelope of the chair frame, i.e. it is substantially coplanar with the chair.

Thus, certain embodiments of the present invention provide a folding chair with a slide out table. The folding chair includes a chair frame that is foldable about a plurality of laterally extending axes between a set up condition and a folded condition, and includes a table that is slidably attached to the chair frame for lateral motion between a deployed position outside a spatial envelope of the chair frame and a stowed position within the spatial envelope of the chair frame, and that is pivotally attached to the chair frame such that when the chair frame is in its set up condition the table is disposed below a seat of the chair frame, and when the chair frame is in its folded condition the table is disposed substantially coplanar with the seat of the chair frame.

For example, the chair according to these embodiments of the invention more specifically includes a fixed bar that is fixedly attached to a forward part of the frame and extends laterally across the chair frame, and a swinging bar that extends laterally across the chair frame and is pivotally attached to the frame rearward of the fixed bar for swinging motion about a laterally extending axis. The fixed bar and the swinging bar locate the table below the seat of the chair frame in the set up condition of the chair frame, and locate the table substantially coplanar with the seat of the chair frame in the folded condition of the chair frame. The fixed bar and the swinging bar extend along the lateral direction of motion of the table between the deployed position and the stowed position. The table may be mounted onto the chair frame by way of a first journal that slidably and pivotally mounts the table to the fixed bar and a second journal that slidably and pivotally mounts the table to the swinging bar. The fixed bar may be fixedly attached to a front leg of the frame, which is pivotally attached to a seat support of the frame, and the swinging bar is pivotally attached to the seat support of the frame.

Other embodiments of the present invention provide a folding chair with a slide out table. The chair includes a generally U-shaped front leg; a generally U-shaped back leg that is pivotally attached to the front leg at upper ends thereof; a generally U-shaped back support that is pivotally attached to the rear leg at approximately a midpoint thereof; and a generally U-shaped seat support that is pivotally attached to the back support. The generally U-shaped members define a chair frame that is foldable about laterally extending axes from a set up condition to a folded condition. The back leg may be pivotally attached to the back support by a pair of over-center links. The chair also includes a table that is slidably and pivotally attached to the front leg and to the back support for lateral motion between a deployed position outside a spatial envelope of the chair frame and a stowed position within the spatial envelope of the chair frame. For example, the table may be slidably and pivotally attached to the seat support of the chair frame via a swinging bar connection. The swinging bar connection may be pivotally attached to the seat support at a seat bracket that also supports the seat support from the back support of the chair frame. Also, the table may be slidably and pivotally attached to the chair frame on a fixed bar that is attached laterally across the front leg. The table may be slidably and pivotally attached on a first journal that is mounted on a fixed bar fastened laterally across the front leg, and on a second journal that is mounted on a swinging bar pivotally attached to the back support for swinging motion about a lateral axis.

Yet other embodiments of the invention may provide a folding chair with a slide out table. The chair includes a chair frame that includes a generally U-shaped front leg, a generally U-shaped back leg, a generally U-shaped back support, and a generally U-shaped seat support, which are pivotally connected to be folded around lateral axes from a set up condition of the chair frame in which the generally U-shaped members all are disposed at obtuse angles with each other to a folded condition of the chair frame in which the generally U-shaped members all are disposed substantially parallel with each other; a swinging bar that extends laterally across the chair frame and hangs pivotally from the seat support; a fixed bar that is fastened laterally across the front leg; and a table slidably and pivotally supported on the swinging bar and on the fixed bar. The table is movable laterally along the swinging bar and the fixed bar between a deployed position outside a spatial envelope of the chair frame and a stowed position within the spatial envelope of the chair frame. The table links the fixed bar to the swinging bar such that when the chair frame is folded from folded from its set up condition to its collapsed or folded condition, the swinging bar swings rearward to move the table from its stowed position below a plane of the seat support into a folded position substantially coplanar with the seat support. In order to fold the chair frame from its set up condition to its folded condition the table must be in its stowed position. The table is slidably and pivotably supported by a first journal on the fixed bar and by a second journal on the swinging bar.

Certain exemplary embodiments, as briefly described above, are illustrated by the following figures.

DRAWINGS

DETAILED DESCRIPTION

Figure 1:
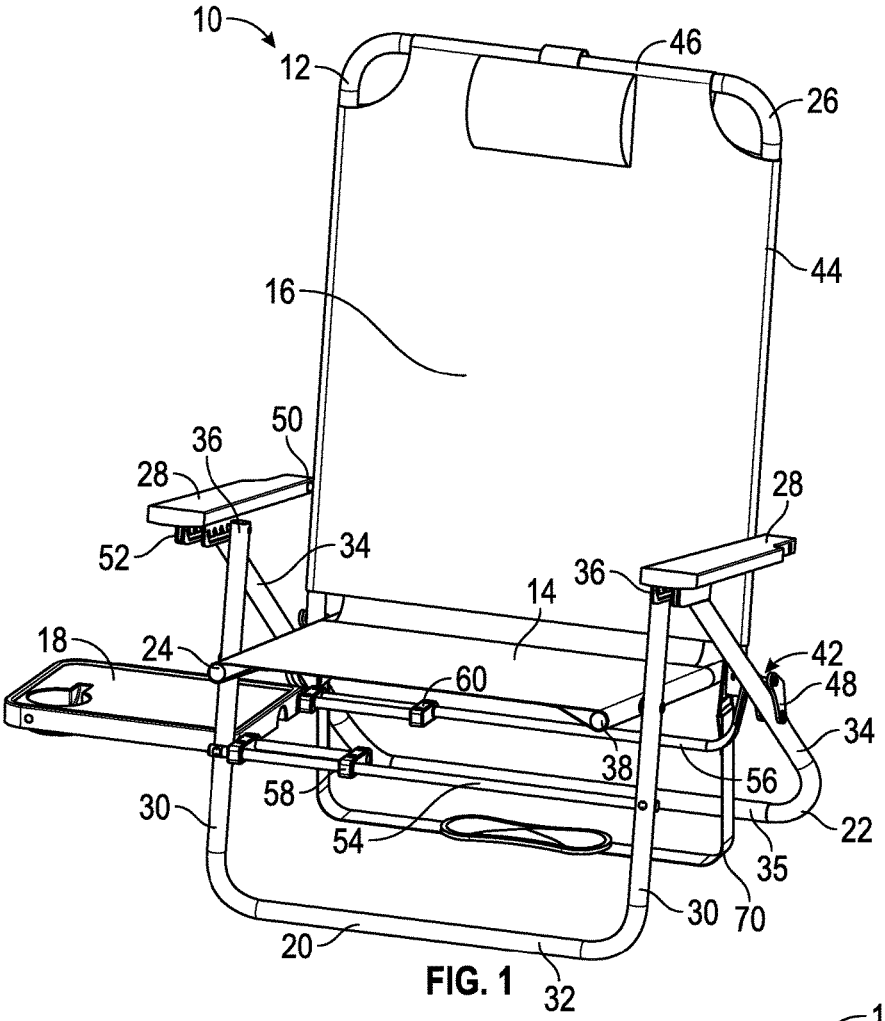
FIG. 1 shows a front perspective view of a folding chair with a slide out table in a deployed position according to an embodiment of the present invention.

Referring to FIG. 1, a folding chair 10 includes a frame 12, a seat 14, a back 16, and a sliding table 18 that is mounted under the seat 14.

The frame 12 includes a front leg 20, a back leg 22, a seat support 24, a back support 26, and armrests 28. The seat 14 is attached on the seat support 24, while the back 16 is attached on the back support 26.

The front leg 20 is generally U-shaped so that it includes two generally vertical side pieces 30 that are joined at their lower ends by a generally horizontal cross piece 32. The back leg 22 similarly is generally U-shaped with two sloped side pieces 34 that are joined at their lower ends by a generally horizontal cross piece 35. The upper ends of the back leg side pieces 34 are pivotally connected to the upper ends of the front leg side pieces 30 at wrist pivots 36. In a set up condition of the chair frame 12, the back leg 22 is angled rearward and downward from the wrist pivots 36. In a collapsed or folded condition of the chair frame 12, the back leg 22 is folded substantially parallel to the front leg 20.

The seat support 24 is generally U-shaped and comprises two side pieces 38, which are connected by a cross piece 39. The side pieces 38 are pivotally connected to the front leg 20 by thigh pivots 40. The side pieces 38 may be pivotally connected to the back support 26 by seat brackets 42 near the cross piece 39. Alternatively, the side pieces 38 of the seat support 24 may be directly pivotally connected to side pieces 44 of the back support 26. In a set up condition of the chair frame 12, the seat support 24 extends generally horizontally rearward from the thigh pivots 40 to the seat brackets 42. The seat support 24 essentially hangs from the back support 26 by way of the seat brackets 42. In a folded condition of the chair frame 12, the seat support 24 extends substantially parallel to and between the front leg 20, the rear leg 22, and the back support 26.

The back support 26 is generally U-shaped and comprises the two side pieces 44 that are joined together by a cross piece 46. At their lower ends, the two back support side pieces 44 are pivotally connected to the back leg side pieces 34 by over-center links 48. The over-center links 48 support the back support side pieces 44 on the side pieces 34 of the back leg 22 when the chair frame 12 is in its set up condition. When the chair frame 12 is collapsed to its folded condition, the over-center links 48 permit the lower ends of the back support side pieces 44 to traverse along the back leg side pieces 34, thereby accommodating the folding kinematics of the chair frame.

The armrests 28 are hingedly connected to the back support 26 at elbow pivots 50, and are movably connected to the upper ends of the back leg side pieces 34 by toothed plates 52. The toothed plates 52 have sawtooth grooves that engage with pins on the back leg side pieces 34, thereby providing means for allowing a user of the chair 10 to adjust the recline position of the chair back 16 while the user is seated in the chair by merely manipulating the armrests 28, 28 while leaning back in the chair to a desired position of recline.

The frame 12 also includes a fixed bar 54, which is fixedly attached across a forward portion of the frame (e.g., the front leg 20); and a generally U-shaped swinging bar 56, which is pivotally attached to the seat support 24 by way of the seat brackets 42. Both the fixed bar 54 and the swinging bar 56 extend generally laterally across the chair frame 12. Both the fixed bar 54 and the swinging bar 56 pivot rearward around lateral axes as the chair frame 12 is folded from its set up condition to its folded or collapsed condition. The fixed bar 54 and the swinging bar 56 support and locate the table 18 with reference to the chair frame 12, as further discussed below.

Figure 2:
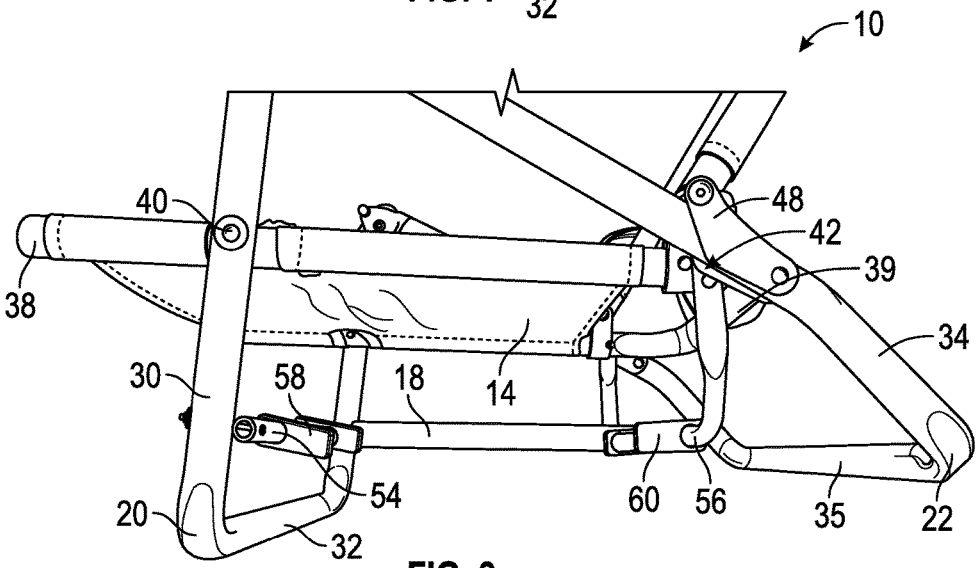
FIG. 2 shows a partial side perspective view of the chair of FIG. 1
Figure 3:
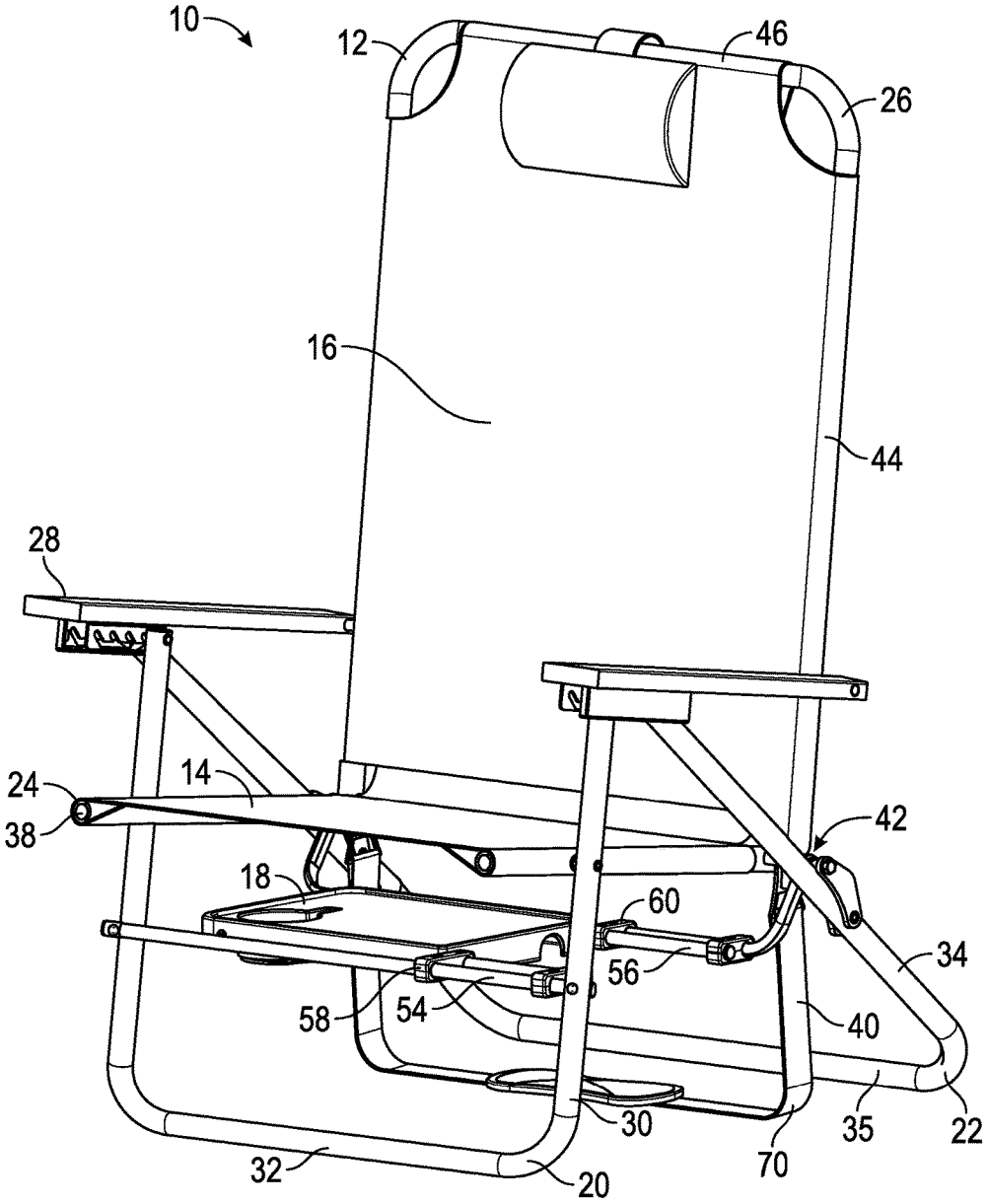
FIG. 3 shows a front perspective view of the chair of FIG. 1 with the slide out table in a stowed position.
Figure 4:
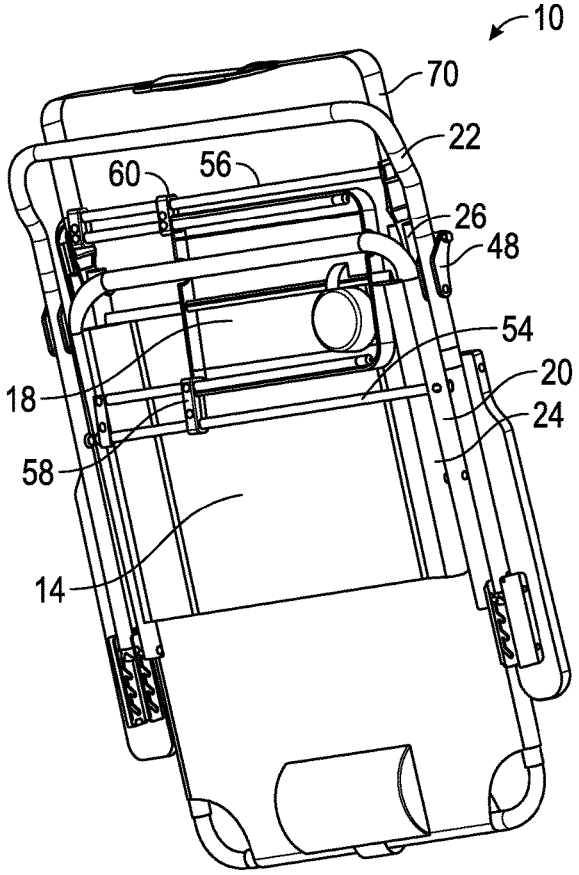
FIG. 4 shows a partial side perspective view of the chair of FIG. 1 in a partly folded condition.
Figure 5:
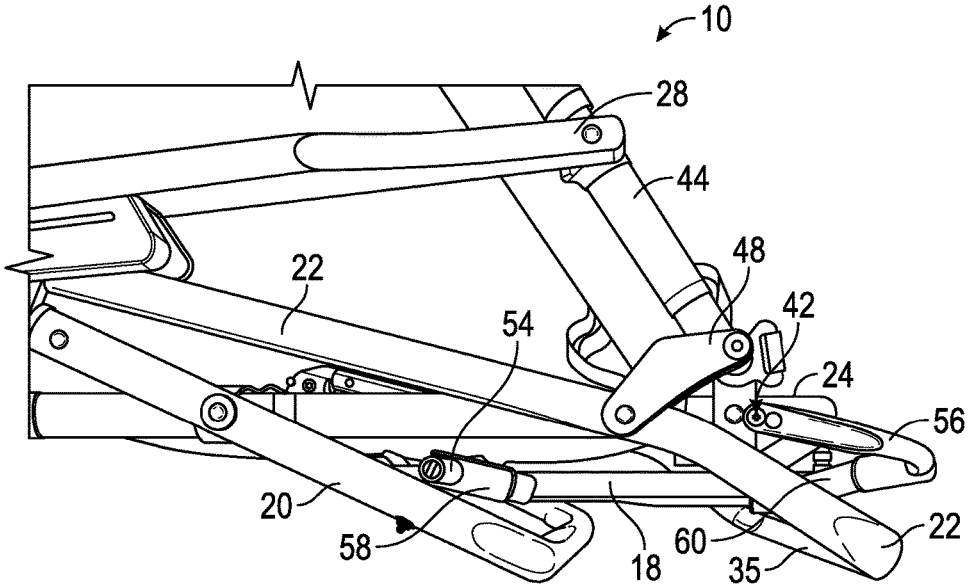
FIG. 5 shows a bottom perspective view of the chair of FIG. 1 in a fully folded condition.

The sliding table 18 is mounted to the chair frame 12 on first and second journals 58, 60, which slidably engage the fixed bar 54 and the swinging bar 56. Thus, the table 18 is extensible and retractable between a deployed position that is outside the spatial envelope of the set up chair frame 12 and a stowed position that is within the spatial envelope of the chair frame 12. FIGS. 1-2 show the table 18 in its deployed position in the set up condition of the chair frame 12. FIGS. 3-5 show the table 18 in its stowed position in set up, partly folded, and fully folded conditions of the chair frame 12.

In the set up condition of the chair frame 12, the swinging bar 56 hangs down from the seat support 24 at the seat bracket 42 so that the fixed bar 54 and the swinging bar 56 locate the table 18 in a plane below the axes of the seat brackets 42, below the seat support 24, and generally parallel with a plane defined by the seat support 24. The table 18 is movable on the journals 58, 60 along the bars 54, 56 between its deployed position and its stowed position. In order for the chair frame 12 to be folded from its set up condition to its collapsed or folded condition, the table 18 must be retracted to its stowed position within the spatial envelope of the chair frame 12.

In folding the chair frame 12 from its set up condition to its collapsed condition, the front leg 20 is folded toward the back leg 22, and the seat support 24 is folded toward the back support 26. During this folding motion, the front leg 20 carries the fixed bar 54 rearward toward the brackets 42, causing the swinging bar 56 to also pivot rearward, thereby shifting the sliding table 18 upward from its stowed position into a folded position substantially coplanar with the seat support 24 and the back support 26. (FIGS. 4-5). By "substantially coplanar" is meant nested within the spatial envelope defined by the seat support 24 and the back support 26, i.e. not significantly protruding beyond the volume of space that is bounded by the seat support 24 and the back support 26.

In order for the chair frame 12 to be folded to its fully collapsed condition, the table 18 must be in its stowed position, i.e. within the spatial envelope of the set up chair frame 12. By stowing the table 18 and then folding the chair frame 12 as described, the sliding table 18 can be accommodated within the spatial envelope of the folded chair frame 12, as shown in FIG. 5.

The components of the frame 12 may be fabricated from metal, plastic, or wooden tube or bar stock. The seat 14 and the back 16 may be fabricated from flaccid or rigid woven or non-woven web material, e.g., cloth, mesh, or plastic panels. The table 18 may be fabricated from rigid metal or plastic mesh or panel stock. The journals 58, 60 may incorporate a lifetime lubricant (e.g., molybdenum grease or graphite powder), or may be fabricated from low-friction material, e.g., nylon or Delrin.

In its folded condition, the chair 10 can be carried by a strap 70 that is connected onto the back support 26. The strap can be any sort of web material, woven or nonwoven cloth or plastic.

Although exemplary embodiments of the invention have been described with reference to attached drawings, those skilled in the art nevertheless will apprehend variations in form or detail that are consistent with the scope of the invention as defined by the appended claims.

What is claimed is:

1. A folding chair with a slide out table, comprising:

a chair frame that is foldable about a plurality of laterally extending axes between a set up condition and a folded condition; and a table that is slidably attached to the chair frame for lateral motion between a deployed position outside a spatial envelope of the chair frame and a stowed position within the spatial envelope of the chair frame, and that is pivotally attached to the chair frame such that when the chair frame is in its set up condition the table is disposed below and spaced apart from a seat of the chair frame, and when the chair frame is in its folded condition the table is disposed substantially coplanar with the seat of the chair frame;

wherein said table is pivotally attached to the chair frame using a fixed bar and a swinging bar;

wherein the fixed bar is fixedly attached to a forward part of the frame and extends laterally across the chair frame;

wherein the swinging bar that extends laterally across the chair frame and is pivotally attached to the frame rearward of the fixed bar for swinging motion about a laterally extending axis;

wherein the fixed bar and the swinging bar locate the table below the seat of the chair frame in the set up condition of the chair frame, and locate the table substantially coplanar with the seat of the chair frame in the folded condition of the chair frame; and wherein the fixed bar and the swinging bar extend along the lateral direction of motion of the table between the deployed position and the stowed position.

2. The chair of claim 1, further comprising:

a first journal that slidably and pivotally mounts the table to the fixed bar; and a second journal that slidably and pivotally mounts the table to the swinging bar.

3. The chair of claim 1, wherein the fixed bar is fixedly attached to a front leg of the frame, which is pivotally attached to a seat support of the frame, and the swinging bar is pivotally attached to the seat support of the frame.

4. The chair of claim 1, said chair frame having a front leg pivotally attached to a back leg and to a seat support, the back leg and the seat support pivotally attached to a back support, and the table slidably and pivotally attached to the front leg and to the back support.

5. The chair of claim 4 wherein the front leg includes a pair of side pieces joined by a cross piece, the back leg includes a pair of side pieces joined by a cross piece, the seat support includes a pair of side pieces joined by a cross piece, and the back support includes a pair of side pieces joined by a cross piece.

6. The chair of claim 4 wherein the back leg is pivotally attached to the back support by a pair of over-center links.

7. The chair of claim 1 wherein the table is slidably and pivotally attached to a front leg of the chair frame and to a seat support of the chair frame.

8. The chair of claim 7 wherein the table is slidably and pivotally attached to the seat support of the chair frame via a swinging bar connection.

9. The chair of claim 8 wherein the swinging bar connection is pivotally attached to the seat support at a seat bracket that also supports the seat support from a back support of the chair frame.

10. A folding chair with a slide out table, comprising:

a generally U-shaped front leg;

a generally U-shaped back leg that is pivotally attached to the front leg at upper ends thereof;

a generally U-shaped back support that is pivotally attached to the rear leg at approximately a midpoint thereof;

a generally U-shaped seat support that is pivotally attached to the back support; and a table slidably and pivotally attached to the front leg and to the seat support for lateral motion between a deployed position outside a spatial envelope of the chair frame and a stowed position within the spatial envelope of the chair frame;

wherein said generally U-shaped members define a chair frame that is foldable about laterally extending axes from a set up condition to a folded condition.

11. The chair of claim 10 wherein the table is slidably and pivotally attached to the seat support of the chair frame via a swinging bar connection.

12. The chair of claim 11 wherein the swinging bar connection is pivotally attached to the seat support at a seat bracket that also supports the seat support from the back support of the chair frame.

13. The chair of claim 10 wherein the back leg is pivotally attached to the back support by a pair of over-center links.

14. The chair of claim 10 wherein the table is slidably and pivotally attached on a fixed bar that is attached laterally across the front leg.

15. The chair of claim 10 wherein the table is slidably and pivotally attached on a first journal that is mounted on a fixed bar fastened laterally across the front leg, and on a second journal that is mounted on a swinging bar pivotally attached to the back support for swinging motion about a lateral axis.

16. A folding chair with a slide out table, comprising:

a chair frame that includes a generally U-shaped front leg, a generally U-shaped back leg, a generally U-shaped back support, and a generally U-shaped seat support, which are pivotally connected to be folded around lateral axes from a set up condition of the chair frame to a folded condition of the chair frame in which the generally U-shaped members all are disposed substantially parallel with each other;

a swinging bar that extends laterally across the chair frame and hangs pivotally from the seat support;

a fixed bar that is fastened laterally across the front leg; and a table slidably and pivotally supported on the swinging bar and on the fixed bar;

wherein the table is movable laterally along the swinging bar and the fixed bar between a deployed position outside a spatial envelope of the chair frame and a stowed position within the spatial envelope of the chair frame.

17. The chair of claim 16 wherein the table links the fixed bar to the swinging bar such that when the chair frame is folded from folded from its set up condition to its collapsed or folded condition, the swinging bar swings rearward to move the table from its stowed position below a plane of the seat support into a folded position substantially coplanar with the seat support.

18. The chair of claim 16 wherein in order to fold the chair frame from its set up condition to its folded condition the table must be in its stowed position.

19. The chair of claim 16 wherein the table is slidably and pivotably supported by a first journal on the fixed bar and by a second journal on the swinging bar.

* * * * *